US006299503B1

(12) United States Patent
Lagrone

(10) Patent No.: US 6,299,503 B1
(45) Date of Patent: Oct. 9, 2001

(54) CHILD SUPPORTING AND AMUSEMENT APPARATUS

(76) Inventor: Paul Lagrone, 4209-192 Place Southwest, Lynnwood, WA (US) 98036

( * ) Notice: Subject to any disclaimer, the term of this patent is extended or adjusted under 35 U.S.C. 154(b) by 0 days.

(21) Appl. No.: 09/564,731

(22) Filed: May 4, 2000

(51) Int. Cl.[7] ..... A63H 33/00

(52) U.S. Cl. ..... 446/227; 446/3; 297/181; 297/217.3

(58) Field of Search ..... 446/3, 7, 175, 446/227, 351, 71; 297/118, 130, 217.3, 181; 472/57, 58, 59, 65, 135

(56) References Cited

U.S. PATENT DOCUMENTS

| | | | | |
|---|---|---|---|---|
| D. 292,758 | | 11/1987 | Bethune . | |
| 1,504,163 | | 8/1924 | Theiss . | |
| 4,464,117 | | 8/1984 | Foerst . | |
| 4,513,981 | | 4/1985 | Degraaff et al. . | |
| 5,032,099 | * | 7/1991 | Chan | 446/175 |
| 5,346,398 | | 9/1994 | Nakahata et al. . | |
| 5,372,505 | | 12/1994 | Smith . | |
| 5,624,156 | * | 4/1997 | Leal et al. | 297/217.4 |
| 6,099,377 | * | 8/2000 | Pridemore | 446/227 |
| 6,183,335 | * | 2/2001 | Peterson | 446/227 |

* cited by examiner

*Primary Examiner*—Jacob K. Ackun, Jr.
*Assistant Examiner*—Alex F. R. P. Rada, III

(57) ABSTRACT

A child supporting and amusement apparatus for soothing and entertaining a child by recreating the experience of riding in a car. The child supporting and amusement apparatus includes a child supporting structure having an opening in a topside thereof and including a passenger compartment and a car seat support member securely disposed in the passenger compartment and which is adapted to support a child restraint seat; and also includes a plurality of screen and cover support members removably and securely mounted along an edge forming the opening in the topside of the child supporting structure; and further includes a cover member having a bottom and being removably and securely mounted above the opening of the child supporting structure and upon the screen and cover support members; and also includes a plurality of toy objects and figurines being securely suspended from the bottom of the cover member; and also includes a vibrating assembly for vibrating the car seat support member; and further includes a screen member carried about by the screen and cover support members; and further includes a sound producing member disposed in the child supporting structure; and also includes a screen member moving and actuating assembly for moving the screen member about the screen and cover support members.

14 Claims, 5 Drawing Sheets

FIG. 7
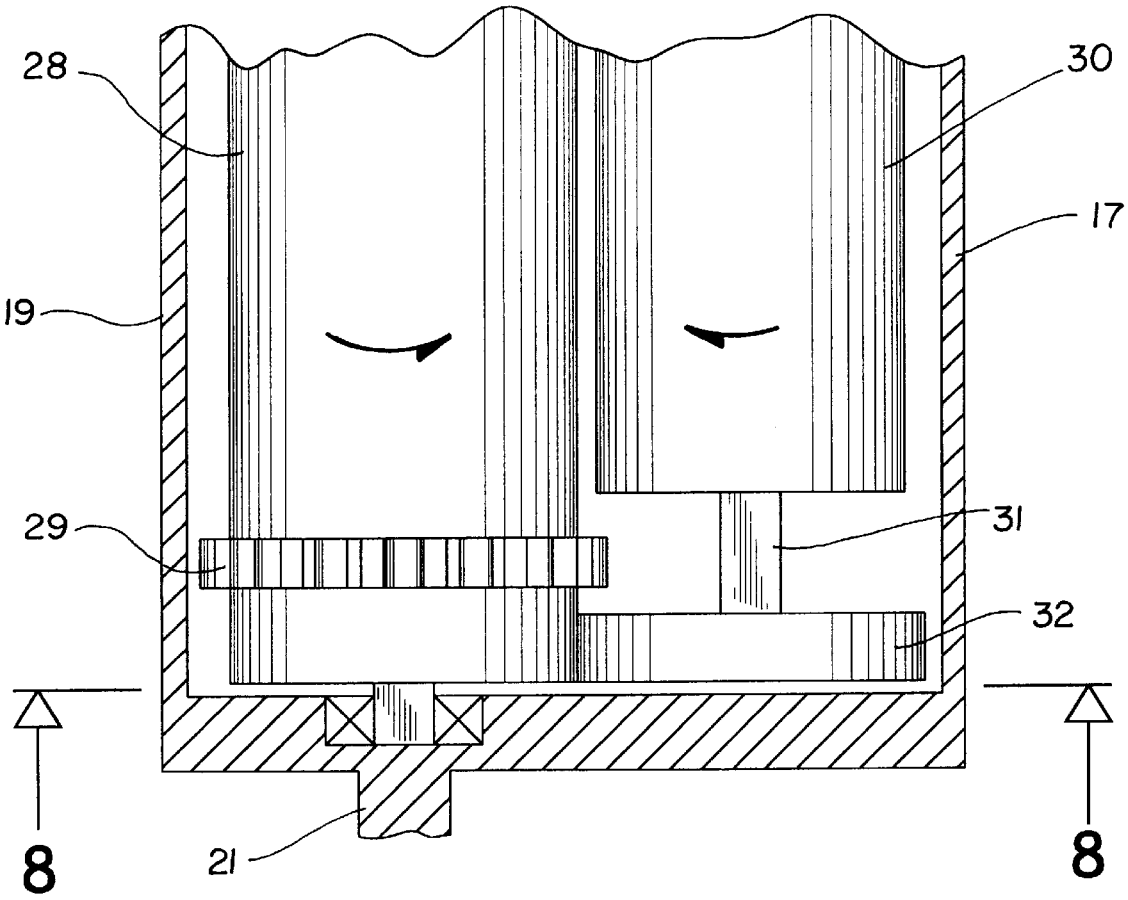
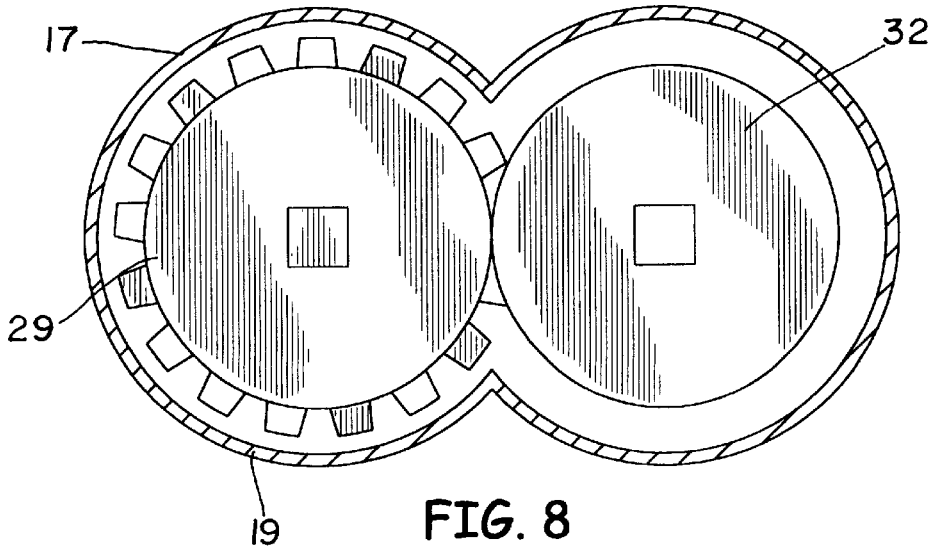
FIG. 8

CHILD SUPPORTING AND AMUSEMENT APPARATUS

BACKGROUND OF THE INVENTION

1. Field of the Invention

The present invention relates to a child care apparatus and more particularly pertains to a new child supporting and amusement apparatus for soothing and entertaining a child by recreating the experience of riding in a car.

2. Description of the Prior Art

The use of a child care apparatus is known in the prior art. More specifically, a child care apparatus heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,513,981; 5,346,398; 1,504,163; 4,464,117; 5,372,505; and U.S. Pat. No. Des. 292,758.

While these devices fulfill their respective, particular objectives and requirements, the aforementioned patents do not disclose a new child supporting and amusement apparatus. The inventive device includes a child supporting structure having an opening in a topside thereof and including a passenger compartment and a car seat support member securely disposed in the passenger compartment and which is adapted to support a child restraint seat; and also includes a plurality of screen and cover support members removably and securely mounted along an edge forming the opening in the topside of the child supporting structure; and further includes a cover member having a bottom and being removably and securely mounted above the opening of the child supporting structure and upon the screen and cover support members; and also includes a plurality of toy objects and figurines being securely suspended from the bottom of the cover member; and also includes a vibrating assembly for vibrating the car seat support member; and further includes a screen member carried about by the screen and cover support members; and further includes a sound producing member disposed in the child supporting structure; and also includes a screen member moving and actuating assembly for moving the screen member about the screen and cover support members.

In these respects, the child supporting and amusement apparatus according to the present invention substantially departs from the conventional concepts and designs of the prior art, and in so doing provides an apparatus primarily developed for the purpose of soothing and entertaining a child by recreating the experience of riding in a car.

SUMMARY OF THE INVENTION

In view of the foregoing disadvantages inherent in the known types of child care apparatus now present in the prior art, the present invention provides a new child supporting and amusement apparatus construction wherein the same can be utilized for soothing and entertaining a child by recreating the experience of riding in a car.

The general purpose of the present invention, which will be described subsequently in greater detail, is to provide a new child supporting and amusement apparatus which has many of the advantages of the child care apparatus mentioned heretofore and many novel features that result in a new child supporting and amusement apparatus which is not anticipated, rendered obvious, suggested, or even implied by any of the prior art child care apparatus, either alone or in any combination thereof.

To attain this, the present invention generally comprises a child supporting structure having an opening in a topside thereof and including a passenger compartment and a car seat support member securely disposed in the passenger compartment and which is adapted to support a child restraint seat; and also includes a plurality of screen and cover support members removably and securely mounted along an edge forming the opening in the topside of the child supporting structure; and further includes a cover member having a bottom and being removably and securely mounted above the opening of the child supporting structure and upon the screen and cover support members; and also includes a plurality of toy objects and figurines being securely suspended from the bottom of the cover member; and also includes a vibrating assembly for vibrating the car seat support member; and further includes a screen member carried about by the screen and cover support members; and further includes a sound producing member disposed in the child supporting structure; and also includes a screen member moving and actuating assembly for moving the screen member about the screen and cover support members.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new child supporting and amusement apparatus which has many of the advantages of the child care apparatus mentioned heretofore and many novel features that result in a new child supporting and amusement apparatus which is not anticipated, rendered obvious, suggested, or even implied by any of the prior art child care apparatus either alone or in any combination thereof.

It is another object of the present invention to provide a new child supporting and amusement apparatus which may be easily and efficiently manufactured and marketed.

It is a further object of the present invention to provide a new child supporting and amusement apparatus which is of a durable and reliable construction.

An even further object of the present invention is to provide a new child supporting and amusement apparatus which is susceptible of a low cost of manufacture with regard to both materials and labor, and which accordingly is then susceptible of low prices of sale to the consuming public, thereby making such child supporting and amusement apparatus economically available to the buying public.

Still yet another object of the present invention is to provide a new child supporting and amusement apparatus which provides in the apparatuses and methods of the prior art some of the advantages thereof, while simultaneously overcoming some of the disadvantages normally associated therewith.

Still another object of the present invention is to provide a new child supporting and amusement apparatus for soothing and entertaining a child by recreating the experience of riding in a car.

Yet another object of the present invention is to provide a new child supporting and amusement apparatus which includes a child supporting structure having an opening in a topside thereof and including a passenger compartment and a car seat support member securely disposed in the passenger compartment and which is adapted to support a child restraint seat; and also includes a plurality of screen and cover support members removably and securely mounted along an edge forming the opening in the topside of the child supporting structure; and further includes a cover member having a bottom and being removably and securely mounted above the opening of the child supporting structure and upon the screen and cover support members; and also includes a plurality of toy objects and figurines being securely suspended from the bottom of the cover member; and also includes a vibrating assembly for vibrating the car seat support member; and further includes a screen member carried about by the screen and cover support members; and further includes a sound producing member disposed in the child supporting structure; and also includes a screen member moving and actuating assembly for moving the screen member about the screen and cover support members.

Still yet another object of the present invention is to provide a new child supporting and amusement apparatus that is convenient and easy to set up and operate and gives the child something to hear and see while the user is off doing something else.

Even still another object of the present invention is to provide a new child supporting and amusement apparatus that is educational for the child because the user can put things up on the screen member for the child to see.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is a detailed partial cross-sectional view of the first one of the screen and cover support members of the present invention.

FIG. 8 is a bottom cross-sectional view of the first one of the screen and cover support members of the present invention.

DESCRIPTION OF THE PREFERRED EMBODIMENT

Figure 2:
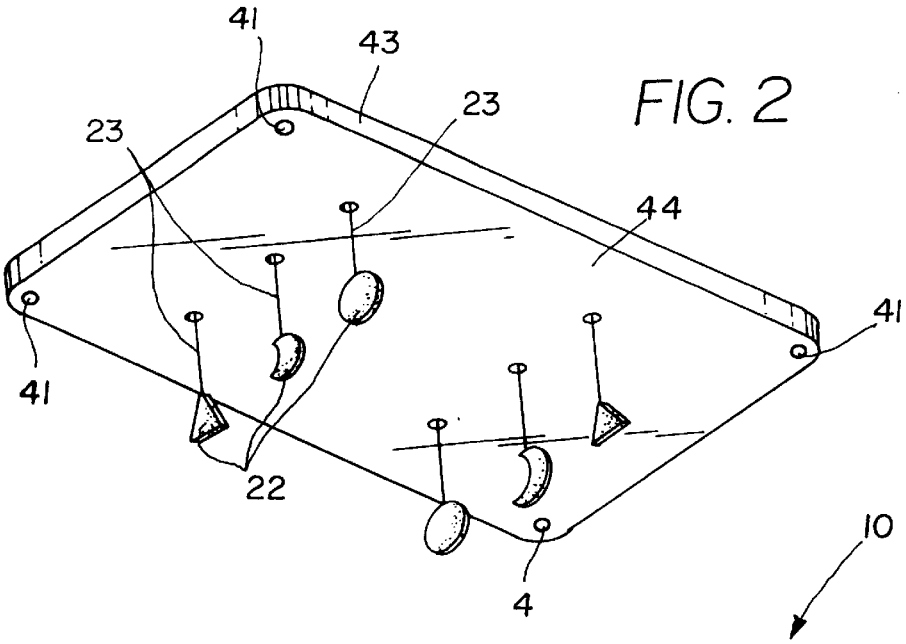
FIG. 2 is a bottom perspective view of the cover member of the present invention.
Figure 1:
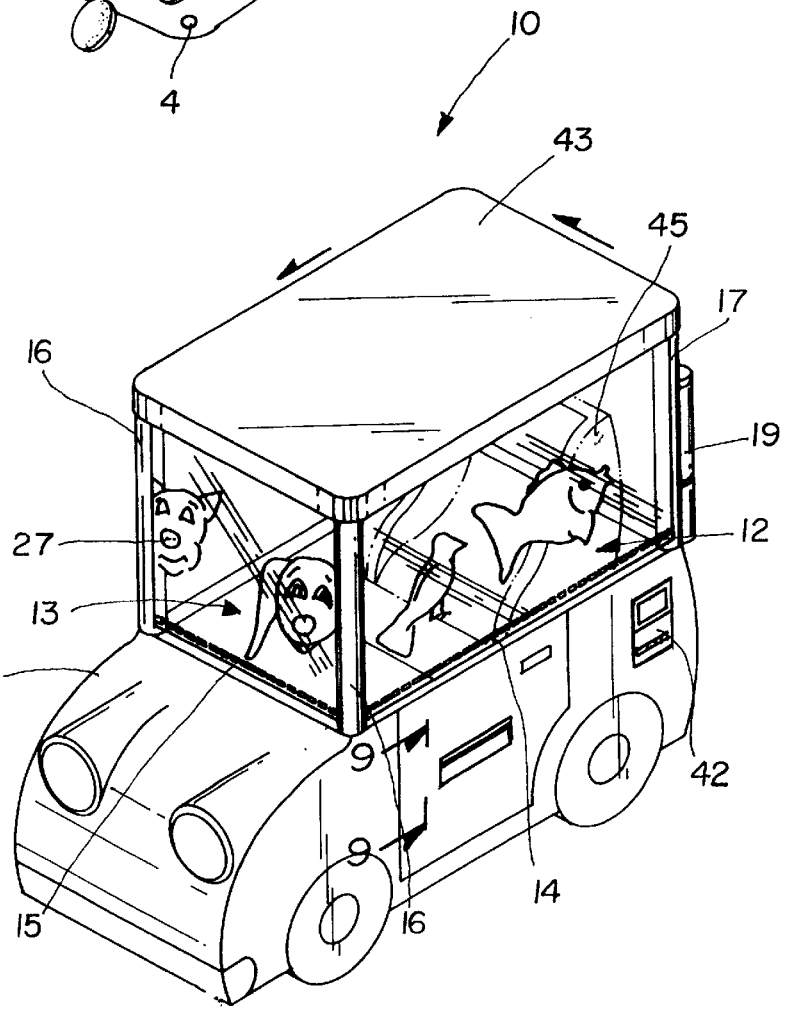
FIG. 1 is a perspective view of a new child supporting and amusement apparatus according to the present invention.
Figure 3:
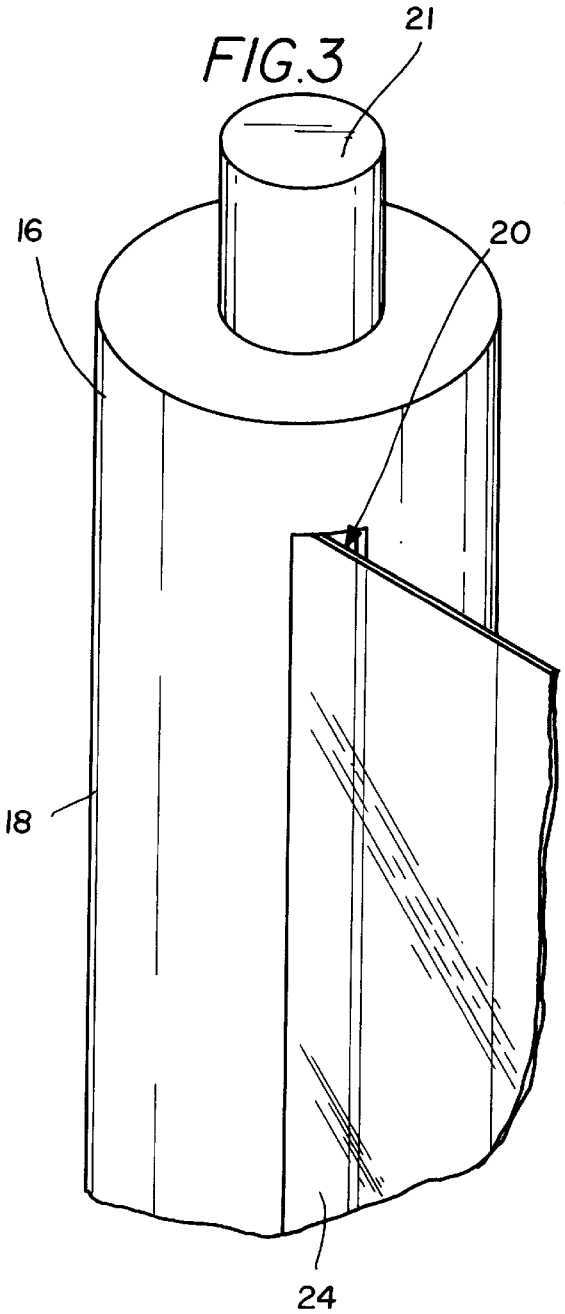
FIG. 3 is a partial top perspective view of one of the screen and cover support members of the present invention.
Figure 4:
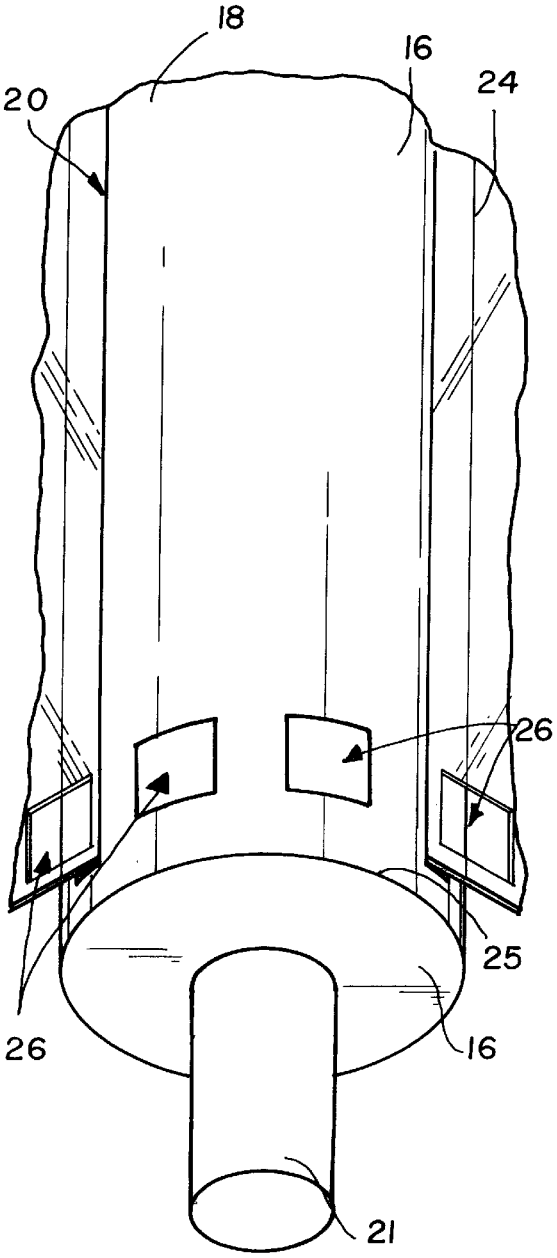
FIG. 4 is a partial bottom perspective view of one of the screen and cover support members of the present invention.
Figure 5:
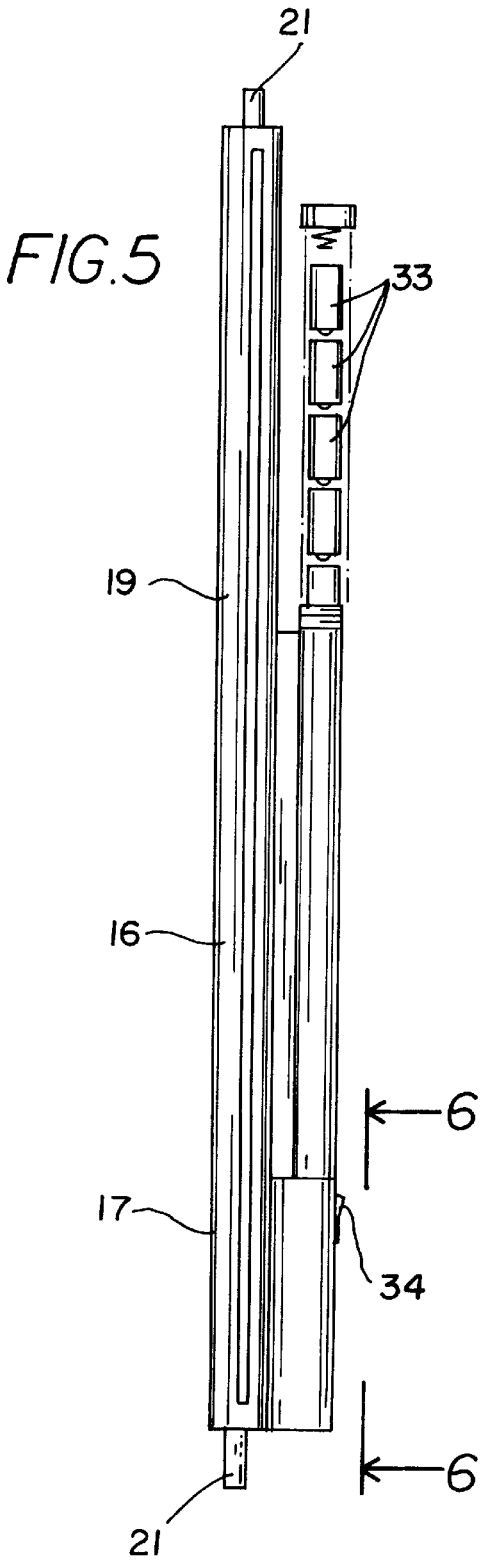
FIG. 5 is a side elevational view of the first one of the screen and cover support members of the present invention.
Figure 6:
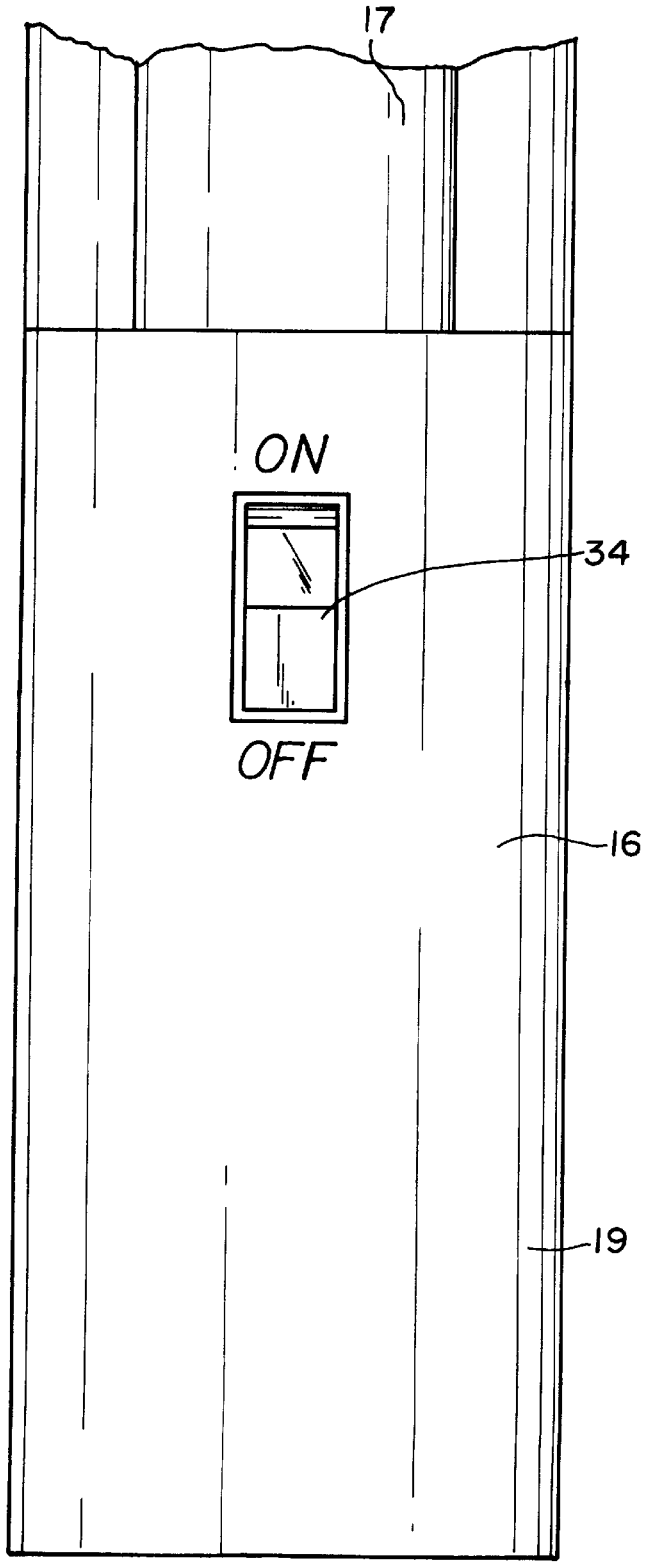
FIG. 6 is a detailed side elevational view of the first one of the screen and cover support members of the present invention.
Figure 9:
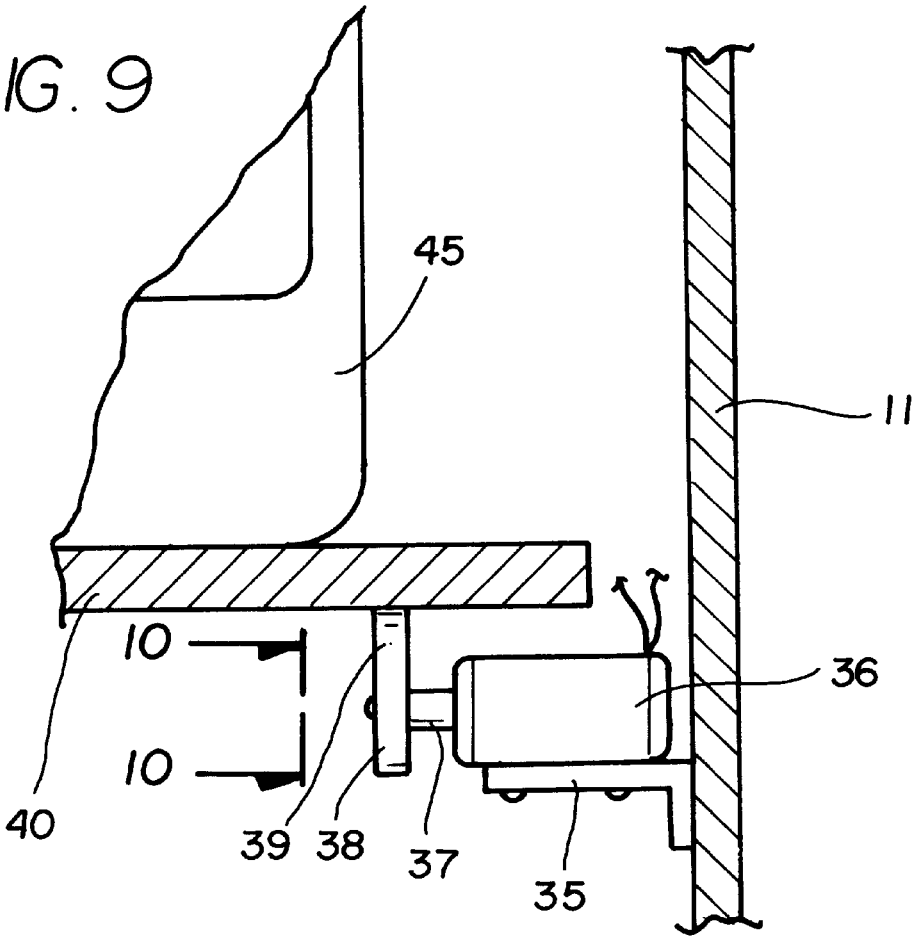
FIG. 9 is a side elevational view of the vibrating means of the present invention.
Figure 10:
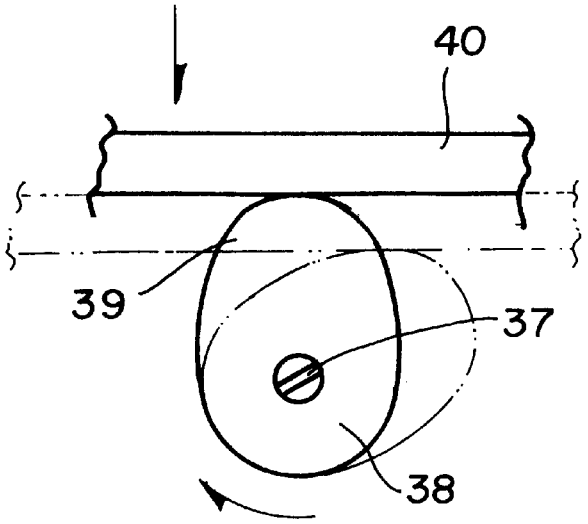
FIG. 10 is a detailed side elevational view of cam member of the present invention.

With reference now to the drawings, and in particular to FIGS. 1 through 10 thereof, a new child supporting and amusement apparatus embodying the principles and concepts of the present invention and generally designated by the reference numeral 10 will be described.

As best illustrated in FIGS. 1 through 10, the child supporting and amusement apparatus 10 generally comprises a child supporting structure 11 having an opening 13 in a topside 14 thereof and including a passenger compartment 12 and a car seat support member 40 movably disposed in the passenger compartment 12 and which is adapted to support a child restraint seat 45 with the child supporting structure 11 being essentially shaped like that of a passenger car.

A plurality of screen and cover support members 16,18 are removably, securely, and conventionally mounted along an edge 15 forming the opening 13 in the topside 14 of the child supporting structure 11. Each of the screen and cover support members 16,18 includes an elongate housing 17,19 having a top end and a bottom end and a plurality of longitudinal slots 20 extending through a wall of the housing 17,19, and also includes a plurality of peg-like members 21 each of which is securely and conventionally attached and welded to and extends from a respective end of the housing 17,19. Each of the screen and cover support members 16,18 is spaced along the edge 15 of the child supporting structure 11.

A cover member 43 having a bottom 44 is removably and securely mounted above the opening 13 of the child supporting structure 11 and upon the screen and cover support members 16,18. The bottom 44 of the cover member 43 includes a plurality of holes 41 spaced along a perimeter thereof with the holes 41 being adapted to receive the peg-like members 21 disposed at the top ends of the housings 17,19. A plurality of toy objects and figurines 22 are securely and conventionally suspended from the bottom 44 of the cover member 43. Each of the toy objects and figurines 22 includes an elongate flexible member 23 having one end securely attached to the bottom 44 of the cover member 43, and also includes one of the toy objects and figurines 22 being securely and conventionally attached to the other end of the elongate flexible member 23 with the toy objects and figurines 22 being adapted to be within reach of a child seated in the child supporting structure 11.

A means for vibrating the car seat support member 40 includes a mounting bracket 35 securely and conventionally attached to a wall of the child supporting structure 11 inside thereof, and also includes a first motor 36 having a rotatable shaft 37 and being securely mounted and bolted upon the mounting bracket 35 and also being adapted to be connected to a first power source, and further includes a cam member 38 having a lobe 39 and being securely and conventionally mounted to the shaft 37 of the first motor 36 for rotation therewith and being in contactable relationship with and supporting a bottom of the car seat support member 40 for moving the car seat support member 40.

A screen member 24 is carried about by the screen and cover support members 16,18. The screen member 24 includes a plurality of openings 26 spaced along near a bottom edge 25 thereof with the screen member 24 being adapted to move through the longitudinal slots 20 of the housings 17,19. The screen member 24 includes a side facing inwardly of the passenger compartment 12 with the side including a plurality of pictures 27 disposed thereupon for the amusement of the child seated in the passenger compartment 12. A sound producing member 42 is securely disposed in the child supporting structure 11 with, the sound producing member 42 being securely and conventionally disposed in an exterior of a wall of the child supporting structure 11 and being adapted to be within reach of a user being outside the child supporting structure 11. The sound producing member 42 is essentially a tape player.

A means for moving and actuating the screen member 24 about the screen and cover support members 16,18 includes a first one 17 of the screen and cover support members which includes a first one 19 of the housings, and also includes an elongate roller member 28 being disposed inside the first one 19 of the housings and having ends journaled in the ends of the first one 19 of the housings, and further includes a sprocket 29 securely and conventionally mounted about a bottom portion of the roller member 28 and being adapted to be removably received in the openings 26 of the screen member 24 for moving the screen member 24, and also includes a second motor 30 having a rotatable shaft 31 and being securely and conventionally mounted in the first one 19 of the housings, and further includes a wheel 32 securely and conventionally mounted to the shaft 31 and being engaged with the roller member 28 for rotation thereof, and also includes a second power source 33 for energizing the second motor 30, and further includes a switch 34 conventionally mounted to a wall of the first one 19 of the housings for energizing the second motor 36. The second power source 33 includes batteries removably disposed in the first one 19 of the housings. The wheel 32 is essentially made of rubber.

In use, the user simply buckles the child in a standard car restraint seat 45 which is supported upon the car seat support member 40, and the user actuates the screen member 24 which is carried about the plurality of screen and cover support members 16,18 with the pictures 27 disposed upon the moving screen member 24 being visible to the child as if the child supporting structure 11 is moving like a car. The user can also turn on the tape player 42 so that the child would hear certain sounds which can be associated with the pictures 27 on the screen member 24. In addition, the user can actuate the vibrating means so that the child is rocked while being inside the child supporting structure 11, all of which is intended to occupy and care for the child while the user can do other things around the home.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A child supporting and amusement apparatus comprising:

a child supporting structure having an opening in a topside thereof and including a passenger compartment and a car seat support member securely disposed in said passenger compartment and which is adapted to support a child restraint seat;

a plurality of screen and cover support members removably and securely mounted along an edge forming said opening in said topside of said child supporting structure;

a cover member having a bottom and being removably and securely mounted above said opening of said child supporting structure and upon said screen and cover support members;

a plurality of toy objects and figurines being securely suspended from said bottom of said cover member;

a means for vibrating said car seat support member;

a screen member carried about by said screen and cover support members;

a sound producing member disposed in said child supporting structure; and a means for moving and actuating said screen member about said screen and cover support members.

2. A child supporting and amusement apparatus as described in claim 1, wherein each of said screen and cover support members includes an elongate housing having a top end and a bottom end and a plurality of longitudinal slots extending through a wall of said housing, and also includes a plurality of peg-like members each of which is securely attached to and extends from a respective said end of said housing, each of said screen and cover support members being spaced along said edge of said child supporting structure.

3. A child supporting and amusement apparatus as described in claim 2, wherein said bottom of said cover member includes a plurality of holes spaced along a perimeter thereof, said holes being adapted to receive said peg-like members disposed at said top ends of said housings.

4. A child supporting and amusement apparatus as described in claim 3, wherein each of said toy objects and figurines includes an elongate flexible member having one end securely attached to said bottom of said cover member, and also includes one of said toy objects and figurines securely attached to the other end of said elongate flexible member, said toy objects and figurines being adapted to be within reach of a child seated in said child supporting structure.

5. A child supporting and amusement apparatus as described in claim 4, wherein said means for vibrating said car seat support member includes a mounting bracket securely attached to a wall of said child supporting structure inside thereof, and also includes a first motor having a rotatable shaft and being securely mounted upon said mounting bracket and also being adapted to be connected to a first power source, and further includes a cam member having a lobe and being securely mounted to said shaft of said motor for rotation therewith and being in contactable relationship with a bottom of said car seat support member for moving said car seat support member.

6. A child supporting and amusement apparatus as described in claim 5, wherein said screen member includes a plurality of openings spaced along near a bottom edge thereof, said screen member being adapted to move through said longitudinal slots of said housings.

7. A child supporting and amusement apparatus as described in claim 6, wherein said screen member includes a side facing inwardly of said passenger compartment, said side includes a plurality of pictures disposed thereupon for the amusement of the child seated in said passenger compartment.

8. A child supporting and amusement apparatus as described in claim 7, wherein said sound producing member is securely disposed in an exterior of a wall of said child supporting structure and is adapted to be within reach of a user being outside said child supporting structure.

9. A child supporting and amusement apparatus as described in claim 8, wherein said sound producing member is essentially a tape player.

10. A child supporting and amusement apparatus as described in claim 9, wherein said means for moving and actuating said screen member includes a first one of said screen and cover support members which includes a first one of said housings, and also includes an elongate roller member having ends journaled in said ends of said first one of said housings, and further includes a sprocket securely mounted about a bottom portion of said roller member and being adapted to be removably received in said openings of said screen member for moving said screen member, and also includes a second motor having a rotatable shaft and being securely mounted in said first one of said housings, and further includes a wheel securely mounted to said shaft and being engaged with said roller member for rotation thereof, and also includes a second power source for energizing said second motor, and further includes a switch mounted to a wall of said first one of said housings for energizing said second motor.

11. A child supporting and amusement apparatus as described in claim 10, wherein said second power source includes batteries removably disposed in said first one of said housings.

12. A child supporting and amusement apparatus as described in claim 11, wherein said wheel is essentially made of rubber.

13. A child supporting and amusement apparatus as described in claim 12, wherein said child supporting structure is essentially shaped like that of a passenger car.

14. A child supporting and amusement apparatus comprising:

a child supporting structure having an opening in a topside thereof and including a passenger compartment and a car seat support member securely disposed in said passenger compartment and which is adapted to support a child restraint seat, said child supporting structure being essentially shaped like that of a passenger car;

a plurality of screen and cover support members removably and securely mounted along an edge forming said opening in said topside of said child supporting structure, each of said screen and cover support members including an elongate housing having a top end and a bottom end and a plurality of longitudinal slots extending through a wall of said housing, and also including a plurality of peg-like members each of which is securely attached to and extends from a respective said end of said housing, each of said screen and cover support members being spaced along said edge of said child supporting structure;

a cover member having a bottom and being removably and securely mounted above said opening of said child supporting structure and upon said screen and cover support members, said bottom of said cover member including a plurality of holes spaced along a perimeter thereof, said holes being adapted to receive said peg-like members disposed at said top ends of said housings;

a plurality of toy objects and figurines being securely suspended from said bottom of said cover member, each of said toy objects and figurines including an elongate flexible member having one end securely attached to said bottom of said cover member, and also including one of said toy objects and figurines securely attached to the other end of said elongate flexible member, said toy objects and figurines being adapted to be within reach of a child seated in said child supporting structure;

a means for vibrating said car seat support member including a mounting bracket securely attached to a wall of said child supporting structure inside thereof, and also including a first motor having a rotatable shaft and being securely mounted upon said mounting bracket and also being adapted to be connected to a first power source, and further including a cam member having a lobe and being securely mounted to said shaft of said motor for rotation therewith and being in contactable relationship with a bottom of said car seat support member for moving said car seat support member;

a screen member carried about by said screen and cover support members, said screen member including a plurality of openings spaced along near a bottom edge thereof, said screen member being adapted to move through said longitudinal slots of said housings, said screen member including a side facing inwardly of said passenger compartment, said side including a plurality of pictures disposed thereupon for the amusement of the child seated in said passenger compartment;

a sound producing member disposed in said child supporting structure, said sound producing member being securely disposed in an exterior of a wall of said child supporting structure and being adapted to be within reach of a user being outside said child supporting structure, said sound producing member being essentially a tape player; and a means for moving and actuating said screen member about said screen and cover support members including a first one of said screen and cover support members which includes a first one of said housings, and also including an elongate roller member having ends journaled in said ends of said first one of said housings, and further including a sprocket securely mounted about a bottom portion of said roller member and being adapted to be removably received in said openings of said screen member for moving said screen member, and also including a second motor having a rotatable shaft and being securely mounted in said first one of said housings, and further including a wheel securely mounted to said shaft and being engaged with said roller member for rotation thereof, and also including a second power source for energizing said second motor, and further including a switch mounted to a wall of said first one of said housings for energizing said second motor, said second power source including batteries removably disposed in said first one of said housings, said wheel being essentially made of rubber.

* * * * *